US007278758B2

(12) United States Patent
Esses

(10) Patent No.: US 7,278,758 B2
(45) Date of Patent: Oct. 9, 2007

(54) MOTION-RESPONSIVE ILLUMINATED GARMENT

(75) Inventor: Ezra Esses, Brooklyn, NY (US)

(73) Assignee: E.S. Originals, Inc., New York, NY (US)

( * ) Notice: Subject to any disclaimer, the term of this patent is extended or adjusted under 35 U.S.C. 154(b) by 95 days.

(21) Appl. No.: 11/225,322

(22) Filed: Sep. 13, 2005

(65) Prior Publication Data

US 2007/0056074 A1 Mar. 15, 2007

(51) Int. Cl.
*F21V 29/00* (2006.01)

(52) U.S. Cl. ..... 362/267; 362/103; 362/234; 362/253; 362/276; 362/411; 362/570; 362/802

(58) Field of Classification Search ..... 362/103, 362/234, 253, 267, 276, 411, 570, 802
See application file for complete search history.

(56) References Cited

U.S. PATENT DOCUMENTS 5,577,828 A * 11/1996 Nadel et al. ..... 362/103
5,688,038 A * 11/1997 Chien ..... 362/103
5,947,580 A * 9/1999 Chien ..... 362/84
6,619,812 B2 * 9/2003 Rapisarda ..... 362/103

* cited by examiner

*Primary Examiner*—Stephen F. Husar
*Assistant Examiner*—Meghan K. Dunwiddie
(74) *Attorney, Agent, or Firm*—Kirschstein, et al.

(57) ABSTRACT

A garment is illuminated with flashing lights in response to movement by a wearer and is protected against water damage.

12 Claims, 2 Drawing Sheets

MOTION-RESPONSIVE ILLUMINATED GARMENT

BACKGROUND OF THE INVENTION

1. Field of the Invention

The present invention generally relates to garments and, more particularly, to a garment which is illuminated in response to motion by a wearer.

2. Description of the Related Art

Garments are, of course, worn by men, women and children, As advantageous as the known garments have been, improvements can still be made in their use, particularly for providing a more visually stimulating appearance.

SUMMARY OF THE INVENTION

OBJECTS OF THE INVENTION

Accordingly, it is a general object of this invention to provide a visually stimulating, eye-catching display on a garment.

Still another object of the present invention is to promote safety when wearing the garment.

FEATURES OF THE INVENTION

In keeping with the above objects and others which will become apparent hereinafter, one feature of the present invention resides, briefly stated, in a motion-responsive illuminated garment, preferably constituted of cloth. The garment includes a lighting module for emitting light in response to motion by the wearer. The module includes a battery, at least one light source and preferably a plurality of light sources, a processor, and a motion-responsive switch for connecting the battery to the processor and to the light sources to cause the latter to flash light in accordance with a pattern determined by the processor.

An overlay is attached to the garment. The overlay bounds with the garment a compartment in which the module is received and held. The overlay is transmissive to the light flashed by the light sources. Preferably, a graphic is provided on the overlay.

Means are provided for resisting entry of water to the module. The water may come from a variety of sources, for example, as moisture evaporating from the wearer's body, as rain, or as wash water used during laundering of the garment. Such water can cause failure of the lights to flash. To resist such failure, the resisting means includes a heat-fused seal extending around a periphery of the overlay and sealing the overlay to the garment and/or a sealed envelope in which the module is sealingly contained and/or a synthetic plastic material for encapsulating the module.

The encapsulated module has opposite, flattened surfaces. Even the light sources, which are preferably light emitting diodes, have electrodes that are flush-mounted with the flattened surfaces of the module, and thus do not provide any raised points which might serve as a source of discomfort when placed adjacent the wearer's body. The encapsulated module is a generally planar disk which does not cause wearer discomfort.

In accordance with this invention, the flashing lights create an eye-catching display whether the garment is worn by day or by night. In addition, the flashing lights enhance the wearer's safety, especially at night, since the wearer is more visible. Still further, many wearers wear garments to bed and, should such wearers walk at night, then the lights serve as a nightlight to guide their way in the dark.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
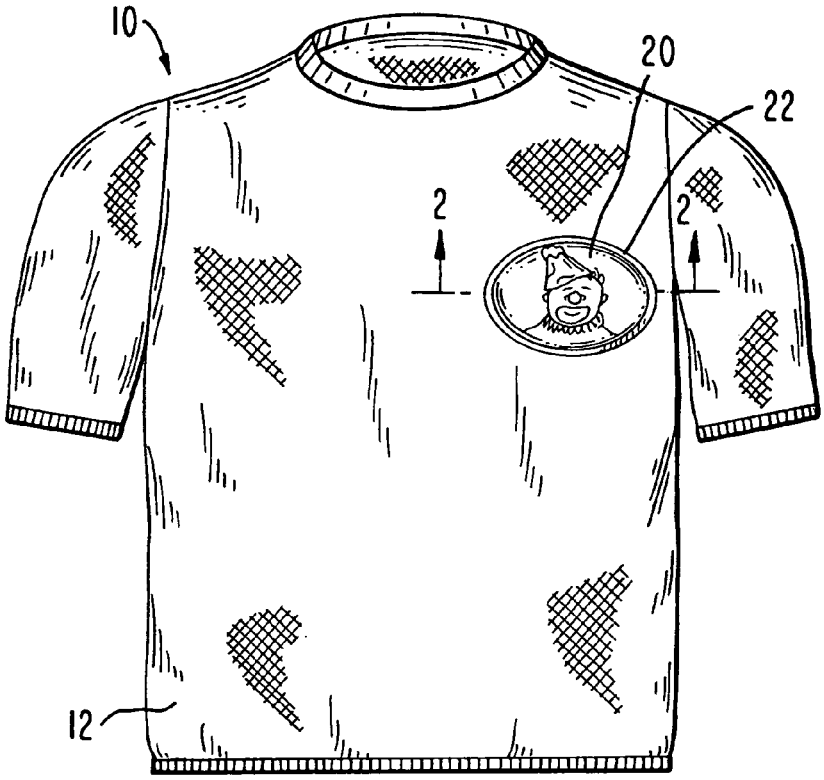
FIG. 1 is a front elevational view of a garment in accordance with this invention.

Referring now to the drawings, reference numeral 10 generally identifies a garment, such as a shirt 12 or blouse. The garment is preferably made of such materials as cotton, wool, nylon, silk, or like cloth material.

Figure 2:
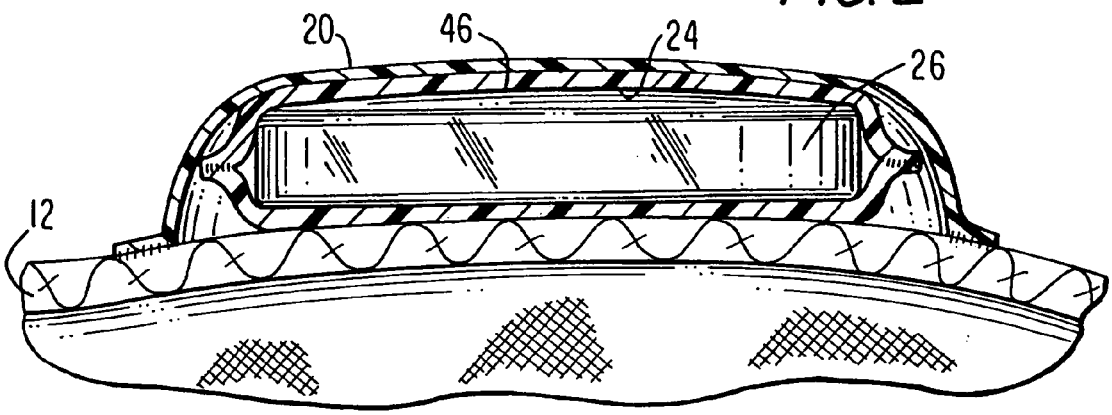
FIG. 2 is an enlarged sectional view taken on line 2-2 of FIG. 1.

An overlay 20 is attached to the garment 18. The overlay 20 is fused to the garment along a heat-fused seal 22 that extends around the entire periphery of the overlay. The overlay is constituted of a soft, flexible, light-transmissive material, such as rubber or plastic, and is preferably molded with a graphic, such as the illustrated three-dimensional clown face, thereon. The overlay forms a compartment 24, as best seen in the sectional view of FIG. 2, with the garment.

Figure 4:
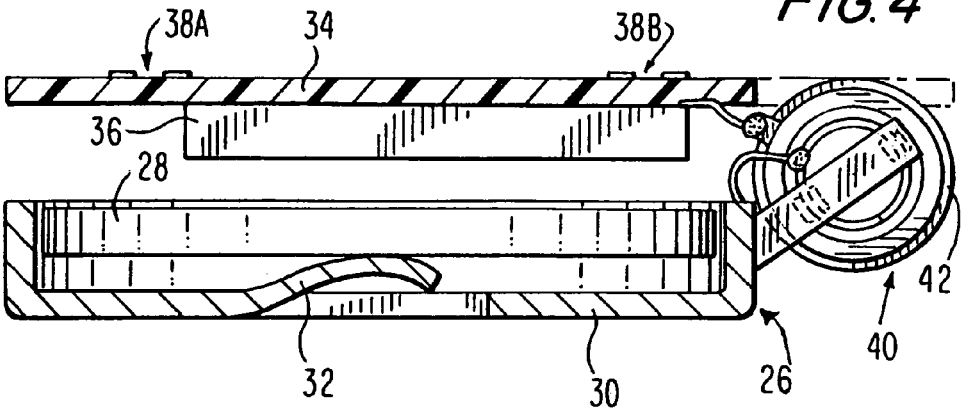
FIG. 4 is an exploded view of the lighting module prior to assembly and encapsulation.
Figure 5:
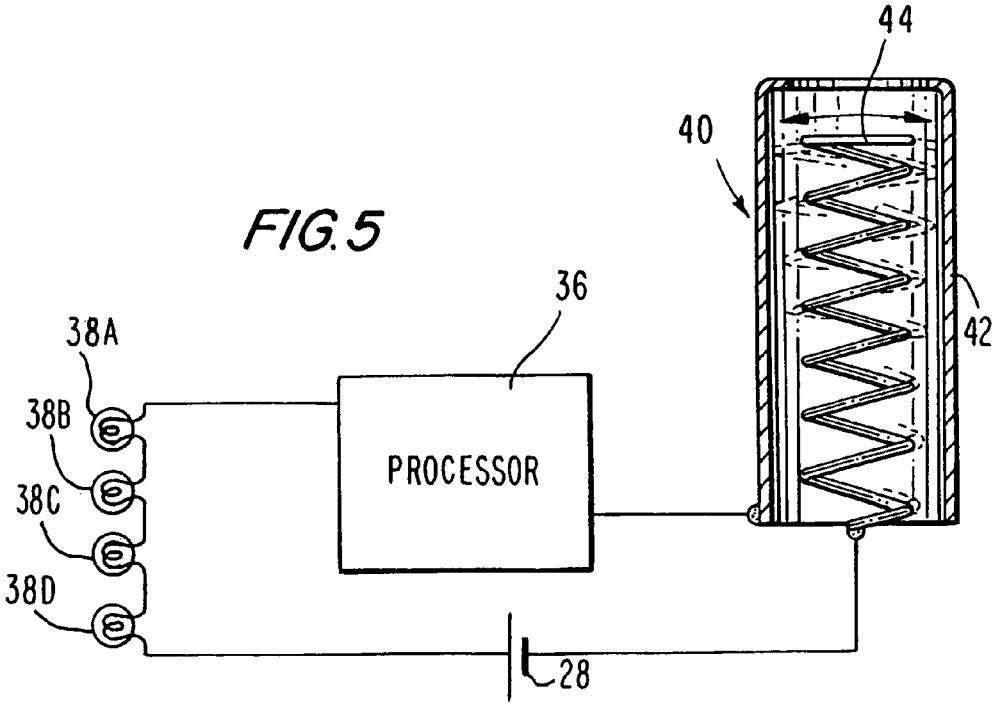
FIG. 5 is an electrical schematic of a circuit used in the lighting module of FIG. 3.

A lighting module 26 is received and held in the compartment 24. As best seen in the exploded view of FIG. 4, the module 26 includes a battery 28, typically a flat circular disk battery commonly used in cameras, a battery holder 30 having a resilient finger 32 for engaging one side of the battery, a planar support such as a printed circuit board 34, a processor 36 mounted on the board 34, at least one light source and preferably a plurality of light sources 38A, B, C, D also mounted on the board 34, and a motion-responsive switch 40 electrically connected to the processor 36, the battery 28, and the light sources 38A, B, C, D in the manner illustrated in the circuit of FIG. 5.

The switch 40 includes an electrically conductive outer sleeve 42 in which an electrically conductive coil spring 44 is mounted for movement between an open position in which the spring is located out of physical conductive contact with the sleeve 42, and a closed position in which the spring contacts the sleeve 42. Motion of the spring is caused by movement of the wearer and, to aid such spring motion, the free end of the cantilevered spring 44 can be weighted.

In the closed position of the switch 40, the processor is energized by the battery and causes the light sources to emit light, preferably flashes of light in a pattern determined by the processor. The pattern may be predetermined or random. The flashing can occur immediately when the closed position is reached, or after a time delay. The flashing is terminated after a predetermined time, or after a randomly chosen time interval. Continuous illumination is contemplated, but not preferred to minimize power consumption.

The light sources are light emitting diodes operative for emitting light of the same or different colors. Each diode includes a pair of planar electrodes, as best seen in FIG. 3, which are flush-mounted on an exterior planar surface of the board 34.

Figure 3:
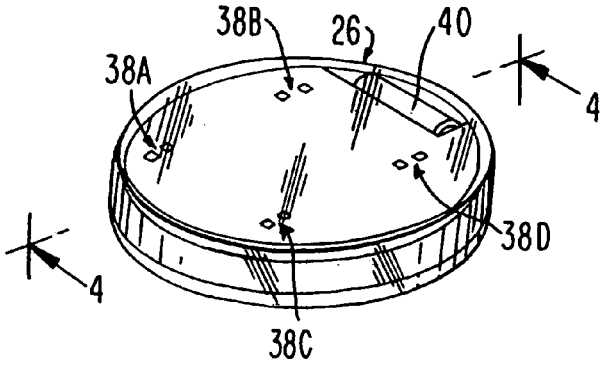
FIG. 3 is a perspective view of an encapsulated lighting module for use with this invention.

As best seen in FIG. 3, the module 26 is encapsulated in a synthetic plastic material which is preferably light-transmissive. The encapsulated module has smooth, flattened major surfaces and has a circular or ovoidal disk shape. All of the components of the module are potted inside the encapsulated plastic, and there are no exposed rough edges. The encapsulating plastic was not shown in FIG. 4 so as not to encumber this drawing.

Water is prevented from entering and damaging the module by the aforementioned seal 20, by the aforementioned encapsulating plastic, and by an envelope comprised of juxtaposed plastic sheets 46, 48 (see FIG. 2) which are sealed about their periphery and which sandwich the module therebetween.

In use, the module is mounted on an exterior surface of the garment. Even if a force presses the module against the wearer, there is no discomfort, because the module has no exposed rough edges and is cushioned by the material of the garment. As the wearer moves, the light emitted by the module passes through the light-transmissive encapsulating plastic, the light-transmissive envelope, and the light transmissive overlay and illuminates the graphic thereon.

It will be understood that each of the elements described above, or two or more together, also may find a useful application in other types of constructions differing from the types described above. For example, the garment need not be a shirt as illustrated, but can be any clothing article, including hats and gloves.

While the invention has been illustrated and described as embodied in a motion-responsive illuminated garment, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

I claim:

1. A motion-responsive illuminated garment, comprising:

a) a lighting module for emitting light in response to motion by the wearer, the module including a battery in the module for supplying electrical power, at least one light emitting diode (LED) in the module, and a motion-responsive switch in the module for connecting the battery to the at least one LED to power the latter to emit light;

b) a flexible overlay having a periphery entirely connected to the garment and bounding therewith a compartment in which the module is received and permanently held, the overlay being transmissive to the light emitted by the module, the overlay having a graphic illuminated by the emitted light; and c) a heat-fused seal extending around the periphery of the overlay and sealing the overlay to the garment, for resisting entry of water to the module.

2. The garment of claim 1, wherein the garment is made of a material selected from a group consisting of cotton, wool, silk, and nylon.

3. The garment of claim 1, wherein the garment is a shirt.

4. The garment of claim 1, wherein the lighting module has a planar surface juxtaposed with the overlay, and an opposite planar surface juxtaposed with the garment.

5. The garment of claim 1, wherein the lighting module includes a processor for flashing the at least one LED when the battery is connected to the at least one LED by the motion-responsive switch.

6. The garment of claim 5, wherein additional LEDs are operatively connected to the processor for flashing all the LEDs in a pattern.

7. The garment of claim 1, wherein the motion-responsive switch includes a coil spring mounted within a sleeve for movement between an open position in which the spring is spaced from the sleeve, to a closed position in which the spring contacts the sleeve.

8. The garment of claim 1, wherein the lighting module includes a planar support, and wherein the at least one light source is a light emitting diode having LED has planar electrodes mounted flush with the planar support.

9. The garment of claim 1, and a sealed, flexible envelope in which the module is sealingly contained.

10. The garment of claim 1, wherein the module is rounded.

11. A motion-responsive illuminated garment, comprising:

a) a lighting module for emitting light in response to motion by the wearer, the module including a battery in the module for supplying electrical power, at least one light emitting diode (LED) in the module, and a motion-responsive switch in the module for connecting the battery to the at least one LED to power the latter to emit light;

b) a flexible overlay having a periphery entirely connected to the garment and bounding therewith a compartment in which the module is received and permanently held, the overlay being transmissive to the light emitted by the module, the overlay having a graphic illuminated by the emitted light; and c) means for resisting entry of water to the module, the resisting means including a sealed, flexible envelope in which the module is sealingly contained, and a synthetic plastic, light-transmissive, material for encapsulating the module.

12. A motion-responsive illuminated garment, comprising:

a) a lighting module for emitting light in response to motion by the wearer, the module including a battery in the module for supplying electrical power, at least one light emitting diode (LED) in the module, and a motion-responsive switch in the module for connecting the battery to the at least one LED to power the latter to emit light;

b) a flexible overlay having a periphery entirely connected to the garment and bounding therewith a compartment in which the module is received and permanently held, the overlay being transmissive to the light emitted by the module, the overlay having a graphic illuminated by the emitted light; and c) a flattened disk in which the module is encapsulated in a synthetic plastic, light-transmissive, material, for resisting entry of water to the module.

* * * * *

US007278758C1

(12) INTER PARTES REEXAMINATION CERTIFICATE (0121st)

United States Patent

Esses

(10) Number: US 7,278,758 C1

(45) **Certificate Issued: *Dec. 1, 2009**

(54) MOTION-RESPONSIVE ILLUMINATED GARMENT

(75) Inventor: Ezra Esses, Brooklyn, NY (US)

(73) Assignee: E.S. Originals, Inc., New York, NY (US)

Reexamination Request:
No. 95/000,329, Dec. 17, 2007

Reexamination Certificate for:

| | |
|---|---|
| Patent No.: | **7,278,758** |
| Issued: | **Oct. 9, 2007** |
| Appl. No.: | **11/225,322** |
| Filed: | **Sep. 13, 2005** |

( * ) Notice: This patent is subject to a terminal disclaimer.

(51) Int. Cl.
*F21V 29/00* (2006.01)

(52) U.S. Cl. ..... 362/267; 362/103; 362/234; 362/253; 362/276; 362/411; 362/570; 362/802

(58) Field of Classification Search ..... None
See application file for complete search history.

(56) References Cited

U.S. PATENT DOCUMENTS

| | | | |
|---|---|---|---|
| 4,774,434 | A | 9/1988 | Bennion |
| 4,848,009 | A | 7/1989 | Rodgers |
| 5,375,044 | A | 12/1994 | Guritz |
| 5,465,197 | A | 11/1995 | Chien |
| 5,577,828 | A | 11/1996 | Nadel et al. |
| 5,622,422 | A | 4/1997 | Rodgers |
| 5,649,755 | A | 7/1997 | Rapisarda |
| 5,688,038 | A | 11/1997 | Chien |
| 5,876,108 | A | 3/1999 | Chien |
| 5,882,110 | A | 3/1999 | Rapisarda |
| 5,947,580 | A | 9/1999 | Chien |
| 5,969,479 | A | 10/1999 | Wong |
| 6,012,822 | A | 1/2000 | Robinson |
| 6,065,851 | A | 5/2000 | So |
| 6,104,140 | A | 8/2000 | Wut |
| 6,481,868 | B1 | 11/2002 | Lin |
| 6,619,812 | B2 | 9/2003 | Rapisarda |
| 7,147,337 | B1 | 12/2006 | Rapisarda |
| 7,267,452 | B2 | 9/2007 | Esses |
| 7,347,577 | B1 | 3/2008 | Rapisarda |
| 2003/0174496 | A1 | 9/2003 | Wong |
| 2004/0251837 | A1 | 12/2004 | Leung et al. |
| 2006/0082987 | A1 | 4/2006 | Dorsey |
| 2007/0159808 | A1 | 7/2007 | Chen |

OTHER PUBLICATIONS

Master Bond Polymer System UV15x–2 Product Description, www.masterbond.com/tds/uv15x–2.html, downloaded on Dec. 4, 2007, Master Bond Inc., 1999–2007.

Beware of men wearing brogues, www.Telegraph.co.uk, downloaded on Dec. 6, 2007, last updated Jun. 24, 2003, Telegraph Media Group Limited.

Carlo Rotella, Someone Else's Chicago, www.washingtonpost.com, Mar. 7, 2004, The Washington Post Company, 2005.

Fred A. Bernstein, Art/Architecture; The Conceptual Prep School: Library as Light Show, www.nytimes.com, Jul. 13, 2003, The New York Times Company, 2007.

Elizabeth Sawin, If the Shoe Doesn't Fit A back–to–school lesson in consumption, www.grist.org/comments/citizen/2002/09/05/shoe/index.html, Sep. 5, 2002, Grist Magazine, Inc. 2007.

Lisa Guernsey, News Watch; Techie Sneakers That Measure A Child's Personal Best, www.nytimes.com, Nov. 18, 1999, The New York Times Company, 2007.

Henry Fountain, Inside the Flashy Shoe That Encourages Children to Step on it, www.nytimes.com, Oct. 7, 1999, The New York Times Company, 2007.

*Primary Examiner*—James Menefee

(57) ABSTRACT

A garment is illuminated with flashing lights in response to movement by a wearer and is protected against water damage.

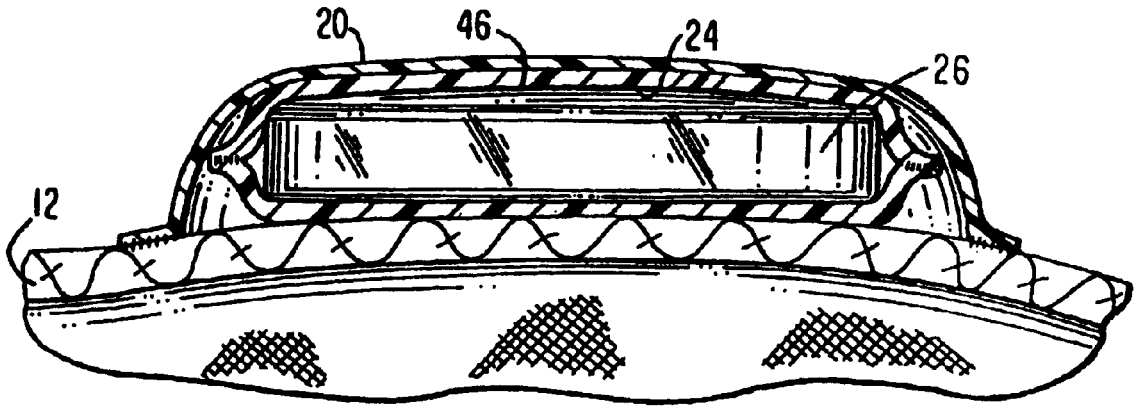

INTER PARTES REEXAMINATION CERTIFICATE ISSUED UNDER 35 U.S.C. 316

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–7, 9–12 is confirmed.

Claim 8 is determined to be patentable as amended.

New claims 13–21 are added and determined to be patentable.

8. The garment of claim 1, wherein the lighting module includes a planar support, and wherein the [at least one light source is a light emitting diode having] LED has planar electrodes mounted flush with the planar support.

*13. The garment of claim 1, wherein the overlay lays entirely over the module containing the battery, the at least one LED, and the motion-responsive switch.*

*14. The garment of claim 1, wherein the heat-fused seal extends around the module and seals the overlay over the module to the garment.*

*15. The garment of claim 1, wherein the sealed, flexible envelope sealingly contains the module between juxtaposed sheets.*

*16. The garment of claim 11, wherein the overlay lays entirely over the module containing the battery, the at least one LED, and the motion-responsive switch.*

*17. The garment of claim 11, wherein the sealed, flexible envelope sealingly contains the module between juxtaposed sheets.*

*18. The garment of claim 12, wherein the overlay lays entirely over the module containing the battery, the at least one LED, and the motion-responsive switch.*

*19. A motion-responsive illuminated garment, comprising:*

*a) a lighting module constituted of a synthetic plastic, light-transmissive material for emitting light through the light-transmissive material in response to motion by a wearer, the module including a battery in the module for supplying electrical power, at least one light emitting diode (LED) in the module, and a motion-responsive switch in the module for connecting the battery to the at least one LED to power the latter to emit the light through the light-transmissive material;*

*b) a flexible overlay laying entirely over the module containing the battery, the at least one LED, and the motion-responsive switch and having a periphery entirely connected to the garment for permanently holding the module on the garment, the overlay being transmissive to the light emitted through the light-transmissive material of the module, the overlay having a graphic illuminated by the light emitted through the light-transmissive material of the module; and*

*c) a heat-fused seal extending around the module and around the periphery of the overlay and sealing the overlay over the module to the garment, for resisting entry of water into the module containing the battery, the at least one LED, and the motion-responsive switch.*

*20. A motion-responsive illuminated garment, comprising:*

*a ) a lighting module constituted of a synthetic plastic, light-transmissive material for emitting light through the light-transmissive material in response to motion by a wearer, the module including a battery in the module for supplying electrical power, at least one light emitting diode (LED) in the module, and a motion-responsive switch in the module for connecting the battery to the at least one LED to power the latter to emit the light through the light-transmissive material;*

*b) a flexible overlay laying entirely over the module containing the battery, the at least one LED, and the motion-responsive switch and having a periphery entirely connected to the garment for permanently holding the module on the garment, the overlay being transmissive to the light emitted through the light-transmissive material of the module, the overlay having a graphic illuminated by the light emitted through the light-transmissive material of the module; and*

*c) a sealed flexible envelope in which the module containing the battery, the at least one LED, and the motion-responsive switch is sealingly contained and sandwiched between juxtaposed plastic sheets, for resisting entry of water into the module.*

*21. A motion-responsive illuminated garment, comprising:*

*a) a lighting module encapsulated in a synthetic plastic, light-transmissive material, for resisting entry of water into the module and for emitting light through the light-transmissive material in response to motion by a wearer, the module being shaped as a flattened disk and including a battery in the module for supplying electrical power, at least one light emitting diode (LED) in the module, and a motion-responsive switch in the module for connecting the battery to the at least one LED to power the latter to emit the light through the light-transmissive material; and*

*b) a flexible overlay laying entirely over the module containing the battery, the at least one LED, and the motion-responsive switch and having a periphery entirely connected to the garment for permanently holding the module on the garment, the overlay being transmissive to the light emitted through the light-transmissive material of the module, the overlay having a graphic illuminated by the light emitted through the light-transmissive material of the module.*

* * * * *